US007234827B2

(12) United States Patent
Fujita

(10) Patent No.: US 7,234,827 B2
(45) **Date of Patent: *Jun. 26, 2007**

(54) CHEMILUMINESCENT DEVICE

(75) Inventor: Masahiko Fujita, Koga (JP)

(73) Assignee: Lumica Corporation, Koga, Fukuoka (JP)

( * ) Notice: Subject to any disclaimer, the term of this patent is extended or adjusted under 35 U.S.C. 154(b) by 225 days.

This patent is subject to a terminal disclaimer.

(21) Appl. No.: 10/756,418

(22) Filed: Jan. 14, 2004

(65) Prior Publication Data

US 2004/0141310 A1 Jul. 22, 2004

Related U.S. Application Data

(63) Continuation-in-part of application No. 10/305,391, filed on Nov. 27, 2002.

(51) Int. Cl.
*F21K 2/00* (2006.01)

(52) U.S. Cl. ..... 362/34; 252/700; 206/219

(58) Field of Classification Search ..... 362/34, 362/260, 84; 252/700; 206/219
See application file for complete search history.

(56) References Cited

U.S. PATENT DOCUMENTS

| | | | | |
|---|---|---|---|---|
| 5,370,828 | A * | 12/1994 | Ladyjensky | 252/700 |
| 5,390,086 | A | 2/1995 | Holland | |
| 5,508,893 | A | 4/1996 | Nowak et al. | |
| 6,021,595 | A * | 2/2000 | Noel | 43/17.6 |
| 6,776,495 | B2 * | 8/2004 | Nomiyama | 362/34 |
| 6,903,262 | B2 * | 6/2005 | Blersch | 174/35 GC |

* cited by examiner

*Primary Examiner*—Thomas M. Sember
(74) *Attorney, Agent, or Firm*—Westerman, Hattori, Daniels & Adrian, LLP.

(57) ABSTRACT

A first object is to prevent the leakage of chemiluminescent liquid during chemiluminescence. A second object is to provide enhanced shock resistance. A third object is to provide enhanced hydraulic-pressure resistance and a product at a low cost. A chemiluminescent device comprises a container, and a synthetic-resin ampoule contained in the flexible container. The ampoule has a surface formed with a groove extending along the circumferential direction thereof.

3 Claims, 10 Drawing Sheets

CHEMILUMINESCENT DEVICE

This application is a Continuation-In-Part of prior application Ser. No. 10/305,391 filed Nov. 27, 2002.

FIELD OF THE INVENTION

The present invention relates to a chemiluminescent device widely applicable to various products utilizing luminescence, such as fishing tools, illuminators, emergency lamps, fish lamps or toys. In particular, the present invention relates to a low-cost chemiluminescent device excellent in shock resistance and/or hydraulic-pressure resistance and capable of preventing the leakage of liquids during use.

BACKGROUND OF THE INVENTION

A conventional chemiluminescent device is constructed in such manner that one of two kinds of liquids is enclosed in a glass ampoule, and the other liquid is filled in a container on the outside of the glass ampoule. Before use, the container is bent to break the glass ampoule so that one liquid in the ampoule and the other liquid are mixed together to generate chemiluminescence.

The conventional chemiluminescent device has the following disadvantages due to the ampoule made of glass.

1. During the operation of breaking the glass ampoule, the resulting glass chips can cause damage such as a hole in the wall of the container. Further, the glass chip would stick out through the hole in the worst case. A thin-walled glass ampoule has been used to prevent such an accident from occurring. However, the thin-walled glass ampoule is subject to breakage due to shocks, such as an accidental drop impact, in the product distribution process. In either case, as long as glass is used as the material of the ampoule, such a problem cannot be cleared up.

2. In case of using the conventional chemiluminescent device as a fish lamp for fish catching, the container will be deformed by hydraulic pressure, and the flatly deformed wall of the container can be damaged by the glass chips with higher probability.

3. The microscopic chips of the broken ampoule act as a catalyst in chemiluminescent reaction likely to create an increased luminescent intensity. This action is unsuited to luminescent devices intended for long-term luminescence.

4. The unburnable glass to be included in the used chemiluminescent device is disadvantageous for disposal treatments.

SUMMARY OF THE INVENTION

The present invention is directed to solve the aforementioned problems of the conventional chemiluminescent device.

Figure 3:
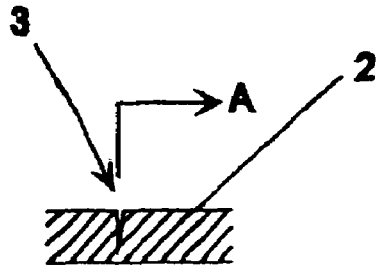
Figure 4:
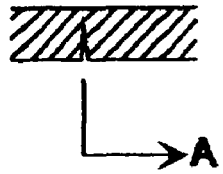
Figure 4:
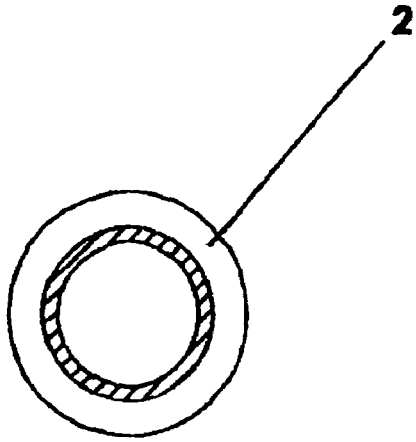
Figure 5:
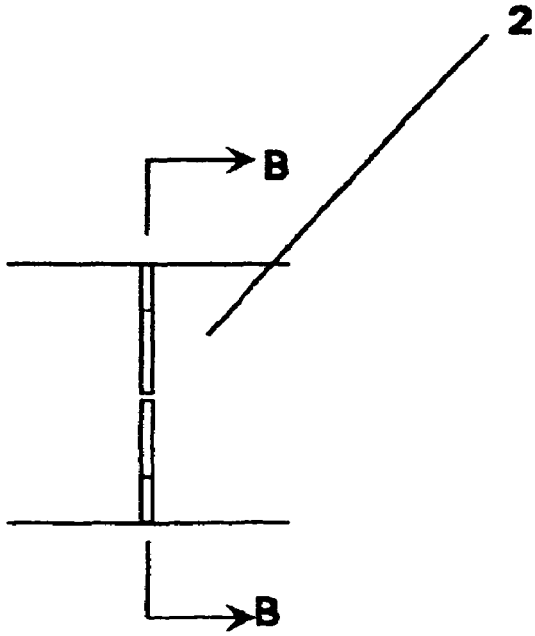
Figure 6:
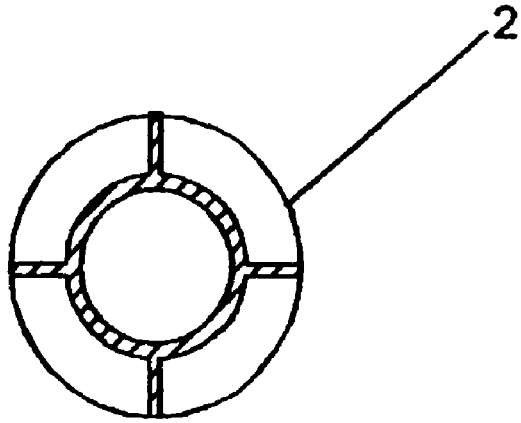
Figure 7:
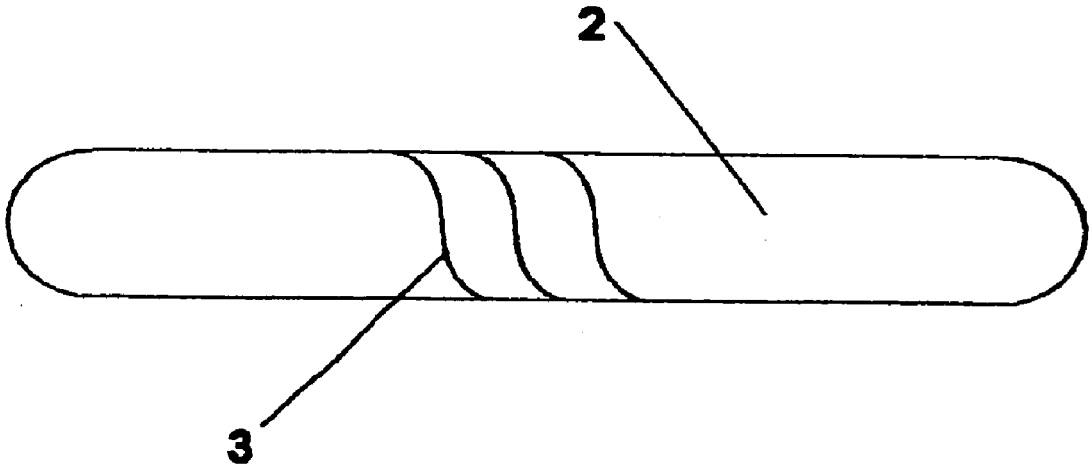
Figure 8:
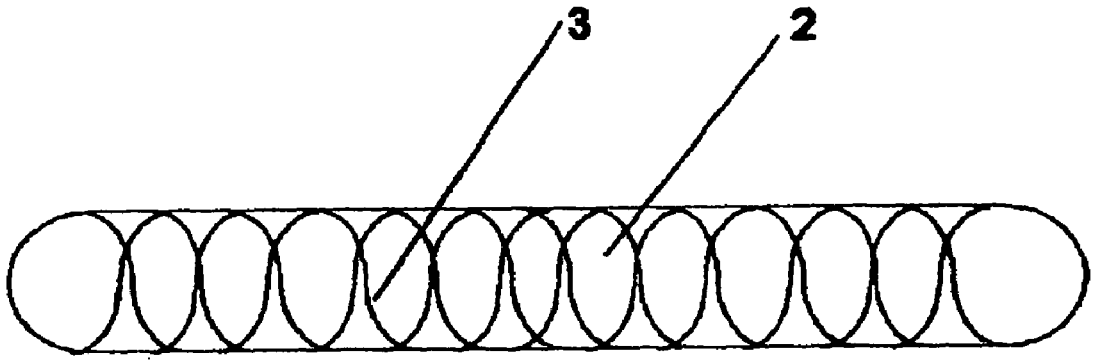

While the respective ends of a material to be formed as an approximately cylindrical synthetic-resin ampoule of the present invention are not limited to a specific shape, at least one of the ends is preferably provided with an opening having a small diameter to facilitate a process of fusedly closing or sealing the opening. The ampoule has a surface formed with a groove, such as a groove extending over the entire circumference of the ampoule as shown in FIGS. 3 and 4, a broken-line-shaped groove having non-grooved portions on the surface as shown in FIGS. 5 and 6, or a spiral groove as shown in FIGS. 7 and 8. It is to be understood that such a groove can be provided in a plural number or formed over the entire surface of the ampoule.

Before use of the chemiluminescent device, the ampoule is broken typically by bending the approximately longitudinal central region of the chemiluminescent device. Thus, it is desired to form the groove in the approximately longitudinal central region of the ampoule. While the groove may be formed in only one position, it is desired to provide a plural number of the grooves to assure a reliable breaking operation because the ampoule can be displaced within the container.

Figure 9:
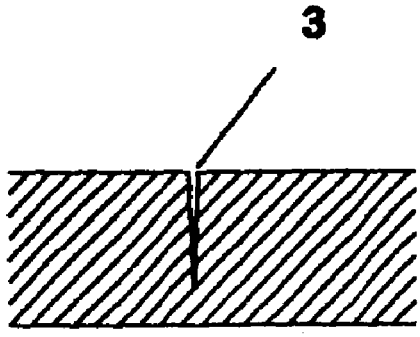
Figure 10:
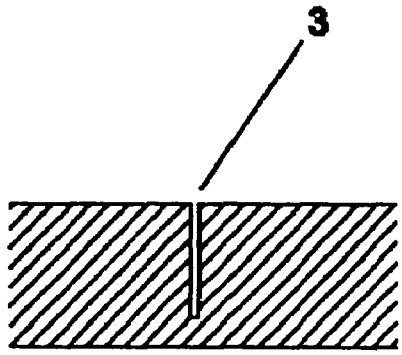

The groove provided in the ampoule may be formed in, but limited to, various shapes as shown in FIGS. 9 and 10. The depth of the groove may be appropriately designed depending on physical properties of selected synthetic resin of the ampoule, such as hardness, resiliency and tensile strength.

Generally, it is desired to select a harder grade in a certain synthetic resin as the martial of the ampoule. The two kinds of liquids can be sufficiently mixed together to generate chemiluminescence by dividing the ampoule at only one grooved portion. If the chemiluminescent device has a long length, it is necessary to divide the ampoule additionally at another grooved portion so as to allow the liquids to be smoothly mixed together.

When the ampoule having the broken-line-shaped or spiral groove formed on the surface thereof is bent and broken, the ampoule is not completely divided or separated into two pieces, and the broken ampoule still has a partially connected portion. After this operation, as the container is returned to its original position by its resilience, the bent ampoule is also returned approximately to its original position to reduce the open area of the broken portion. This allows the two kinds of liquids to be limitedly or gradually mixed together so as to maintain the chemiluminescent for a long time. Since no glass ampoule is used, the outer container can have a wall having a reduced thickness. The container used in the conventional chemiluminescent device has a wall thickness of 1.0 to 1.5 mm, whereas the wall thickness of the container of the present invention can be reduced down to 0.3 to 0.7 mm. The thin-walled container provides enhanced light transmittance. In addition, even if a hydraulic pressure acts on the chemiluminescent device, the thin-walled container can be adequately deformed to prevent occurrence of crack or fracture in the welded portion created during its molding process.

In particular, the present invention allows the chemiluminescent device to be applied to a fish lamp usable at deep ocean, for example, under the depth of 800 to 1000 mm. In the conventional chemiluminescent device, one of the liquids is enclosed in the glass ampoule by fusedly sealing the aforementioned opening with gas flame or the like. In this process, it is required to leaving a certain space between the opening and the level of the liquid to prevent burning of the liquid. This space will be added to the space of the container when the chemiluminescence is generated. In case of using the conventional chemiluminescent device at deep ocean, a certain hydraulic pressure acts on the entire container to compress the space and deform the container. For example, about 100 atm of hydraulic pressure acts at a water depth of 1000 mm. It is desired to minimize the space to prevent the deformation of the container due to such hydraulic pressure.

Resin has a melting temperature significantly lower than that of glass. Thus, the synthetic resin ampoule of the present invention can be formed by fusedly sealing the opening while leaving only a small space therein without any adverse affect on the liquid. For example, polypropylene or polyethylene having a melting temperature of 100 to 200° C. can eliminate the need for sealing the opening by using a gas flame of 800 to 1000° C. Thus, the chemiluminescent device of the present invention allows the space in the ampoule or the total space in the container to be minimized so as to suppress the deformation of the container and prevent any accident such as the breakage of the container.

The container and the ampoule of the present invention may be made of resin such as polyethylene, polypropylene, polyethylene terephthalate or nylon. However, the resin is not limited to such materials but any other suitable resin having chemical stability may be used.

The container or the ampoule of the present invention is not limited to a monolayered structure, but may be formed as a multilayered structure made of different materials. For example, a water-impermeable material such as vinylidene chloride may be used as an intermediate layer, or an aluminum thin layer may be used as an outer or inner layer. This structure can prevent mutual interference between the two kinds of liquids and adverse affects from the outside of the container to provide a product having a long-term stability.

While the following materials can be used as the chemiluminescent liquid of the present invention, they are simply shown as an example, and the composition of the chemiluminescent liquid is not limited to such materials.

One of the two kinds of liquids is an oxidizing liquid, and the other is a fluorescent liquid. The oxidizing liquid may be composed of dimethyl phthalate, t-butyl alcohol, hydrogen peroxide, and sodium salicylate serving as a catalytic agent. The fluorescent liquid may be composed of dibutyl phthalate, bis(2,4,5-trichloro-6-carbopentoxyphenyl)oxalate, and 1-chloro 9,10-bis(phenylethynyl)anthracene serving as a fluorescent material.

There have been known various other fluorescent materials such as 1,8-dichloro 9,10-bis(phenylethynyl)anthracene, 2-chloro 9,10-bis(4-phenylethynyl)anthracene, 1,6,7,12-tetraphenoxy-N,N'-bis(2,6-diisopropylphenyl)-3,4,9,10-perylene dicarboxyimide. Any color may be selected by combining two or more of the above fluorescent materials.

Figure 1:
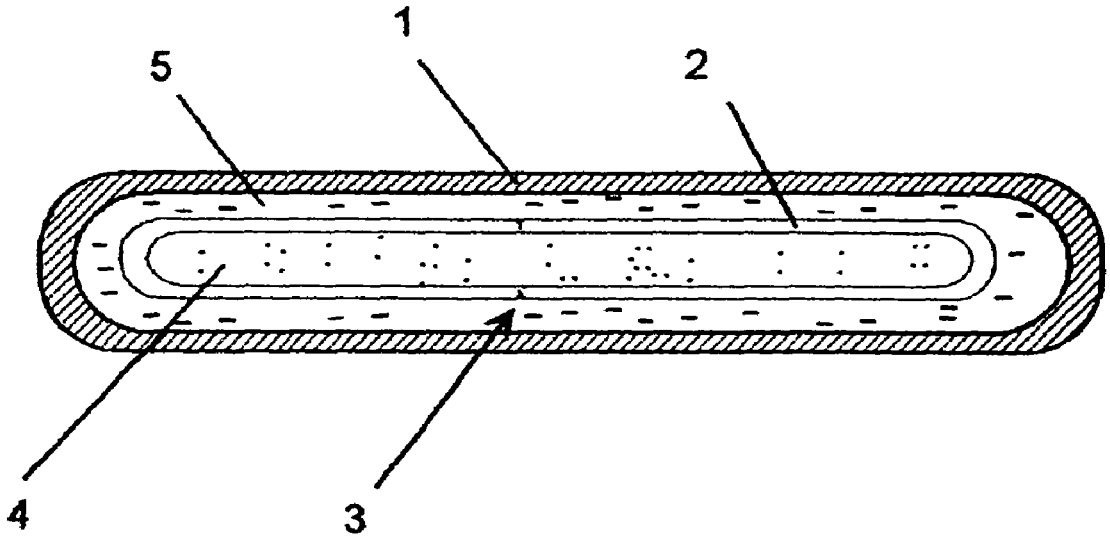

BRIEF DESCRIPTION OF THE DRAWINGS (FIG. 1) An explanatory sectional view of a first embodiment of the present invention.

Figure 2:
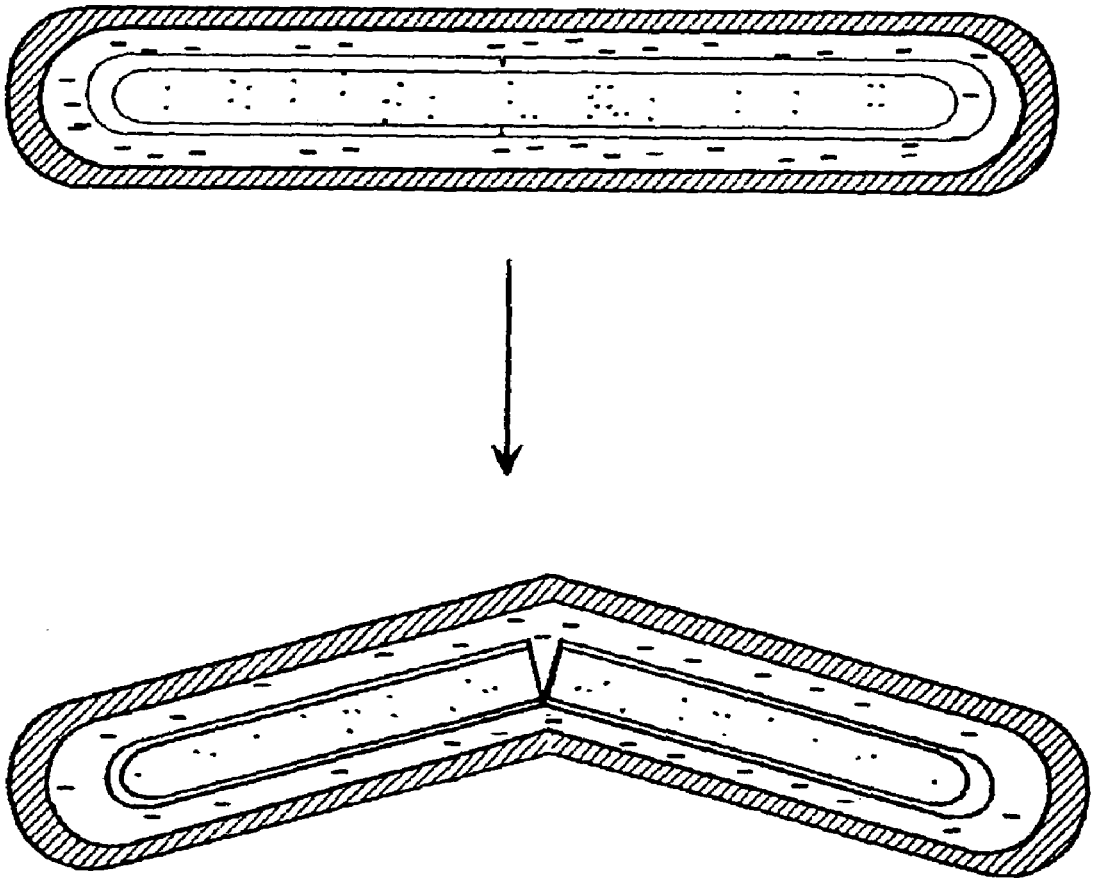

(FIG. 2) An explanatory view showing the state when the first embodiment is used.

(FIG. 3) An enlarged sectional view of a grooved portion of the first embodiment.

(FIG. 4) A sectional view taking along the line A—A in FIG. 3.

(FIG. 5) An enlarged view of a portion of an ampoule formed with a broken-line-shaped groove.

(FIG. 6) A sectional view taking along the line B—B in FIG. 5.

(FIG. 7) A view of a portion of an ampoule formed with a spiral groove.

(FIG. 8) A view of an ampoule formed with a cross spiral groove.

(FIG. 9) An enlarged sectional view of a V-shaped groove.

(FIG. 10) An enlarged sectional view of a U-shaped groove.

Figure 11:
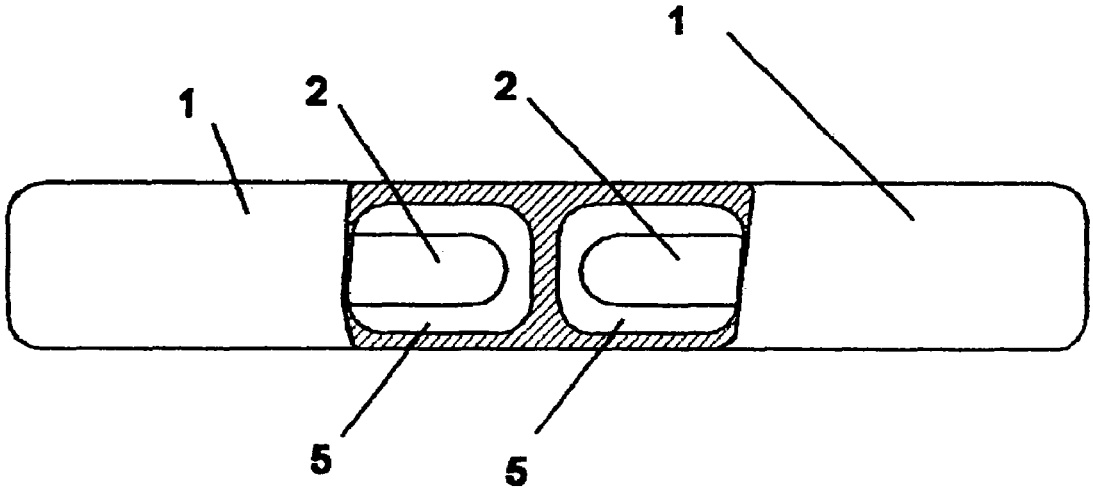

(FIG. 11) An explanatory sectioned view of a second embodiment.

Figure 12:
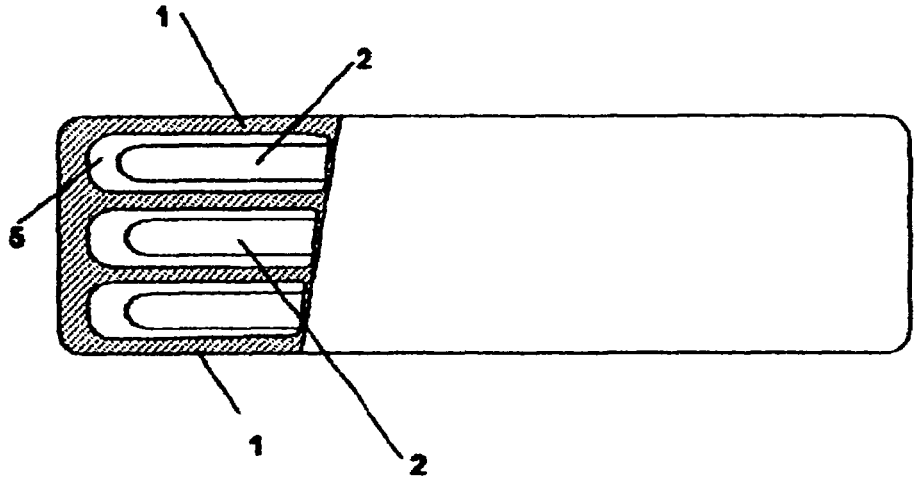

(FIG. 12) An explanatory sectioned view of a third embodiment.

Figure 13:
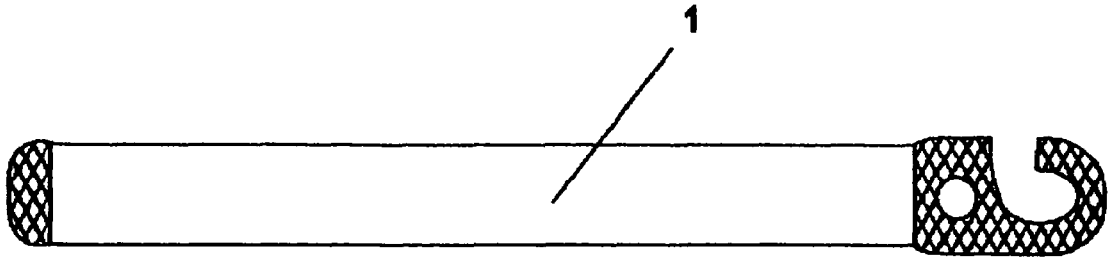

(FIG. 13) A view of a container having a hook with a hole attached thereto.

Figure 14:
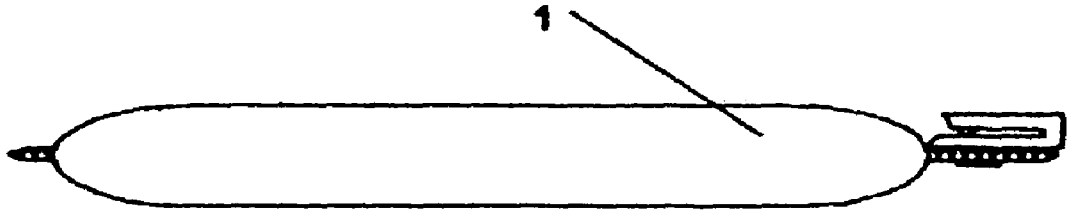

(FIG. 14) A view of a container having a hook attachment at one of the ends thereof.

(FIG. 15) An explanatory perspective view of one process of forming pinholes in the surface of a tube.

Figure 15:
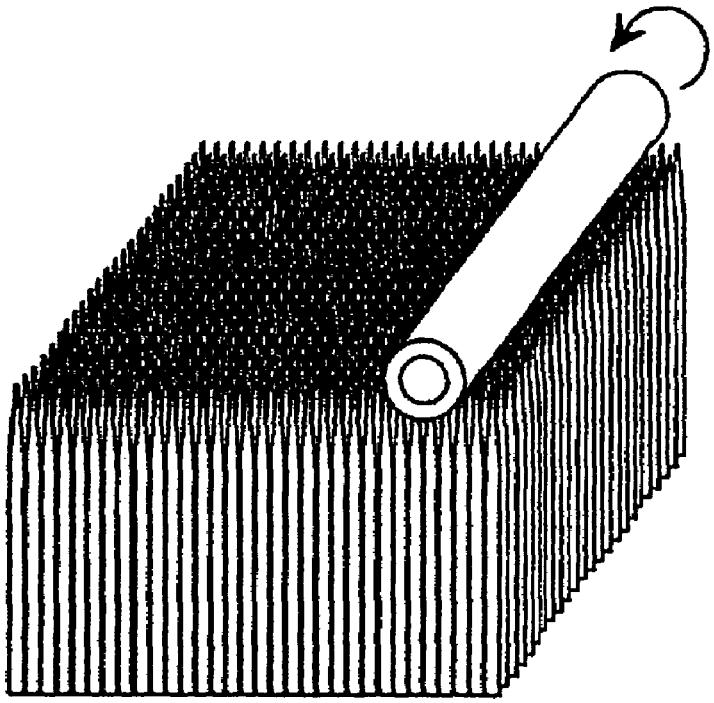
Figure 16:
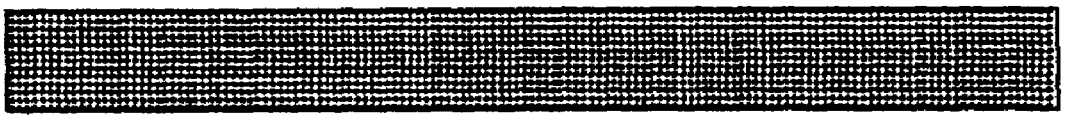

(FIG. 16) A top plan view of the tube with the pinholes formed through the process in FIG. 15.

(FIG. 17) An explanatory perspective view of another process of forming pinholes in the surface of a tube.

Figure 17:
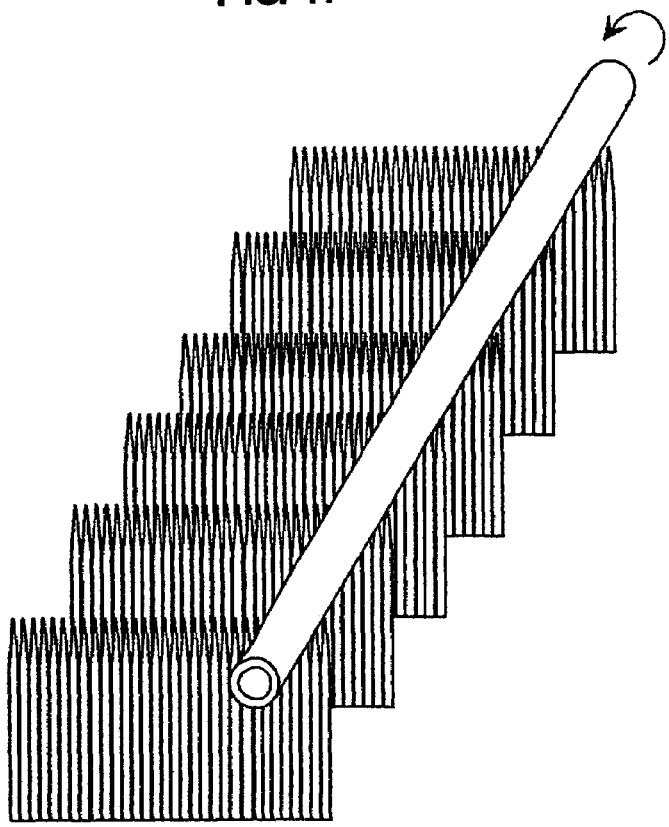

(FIG. 18) A top plan view of the tube with the pinholes formed through the process in FIG. 17.

REFERENCE NUMERALS

1: container;
2: ampoule;
3: groove;
4: oxidizing liquid;
5: fluorescent liquid

PREFERRED EMBODIMENT

The sectional shape of the approximately cylindrical ampoule of the present invention is not limited to a perfect circle, but may be ellipse or oval. Further, the container is not limited to a specific shape, but any other suitable shape capable of containing the ampoule may be used.

(First Embodiment)

On of the ends of a polyethylene pipe having an inner diameter ϕ of 9.5 mm and an outer diameter of 10.5 mm is fusedly closed or sealed. A fluorescent liquid of 3.2 cc is charged into the container.

Then, with a cutting tool, one groove having a depth of 0.5 mm is formed on the longitudinal central region of a polypropylene ampoule having an inner diameter ϕ of 5.8 mm and an outer diameter of 7.5 mm, over its entire circumference.

After charging an oxidizing liquid of 1.6 cc into the ampoule, an opening of the ampoule is fusedly sealed. Then, the ampoule is inserted into the container, and the other end of the container is fusedly sealed.

Before use, when the container is bent while holding both ends of the container by hand, the ampoule contained in the container is simultaneously bent, and broken along the groove by tensile stress. Thus, the respective liquids in the ampoule and the container are mixed together to initiate chemiluminescence. While the ampoule is usually divided into two pieces by the above operation, the broken ampoule has a partially connected portion in some case.

In this case, the container can be bent in the opposite direction to divide the ampoule completely into two pieces.

(Second Embodiment)

This embodiment includes two of the above containers integrally combined in its longitudinal direction. In use, all of the containers may be operated to simultaneously generate chemiluminescence, or only one of the containers may be operated to generate chemiluminescence ahead of another container. Further, the luminescent color in each of the containers may be changed.

(Third Embodiment)

This embodiment includes three containers integrally combined in its lateral direction, and the ampoule is contained in each of the containers.

While the present invention has been described in connection with the chemiluminescent devices including a plastic ampoule (tube) with a surface formed with a groove, another technique for allowing the ampoule (tube) to be broken in the same manner as above will be further described below.

A tube is molded using hard polypropylene. Typically, an extruder or extrusion molding machine is used in this process.

The hard polypropylene includes a polymer consisting of propylene, and a copolymer of propylene and α-olefin. It is desired to select a copolymer containing a less amount of α-olefin because a greater amount of α-olefin provides higher flexibility. Based on various experimental results, the hard polypropylene preferably has a hardness of 90 or more, more preferably 100 or more, in Rockwell hardness (R scale) JIS K6921.

When a needle is pierced in and pulled out of the surface of the wall of the tube at one point without penetrating through the wall, and the tube is bent while facing the pierced portion or pinhole outward, the tube is broken with a sound due to stress concentrated at the pinhole and divided completely into two. In this manner, a number of pinholes are formed in at least one region extending along its entire circumference of the tube to allow the tube to be broken regardless of a bending direction of the tube. The tube may be made of polyethylene having adequate hardness and low flexibility. Specific embodiments using this technique will be described below.

(Fourth Embodiment)

A tube (pipe) is made of polypropylene having a Rockwell hardness of 102.

A number of needles each having an acicular end and a diameter of 0.6 mm are arranged to stand upright in contact with each other while orienting the acicular ends upward so as to allow the acicular ends to form a top surface having a larger area than the area of the peripheral surface of the tube. The tube is pressed onto and rolled along the surface formed of the acicular ends of the needles while preventing the acicular ends from penetrating through the wall of the tube (see FIG. 15). As a result, a number of needle marks are created over substantially the entire surface of the tube in the form of independent dots (see FIG. 16). Then, after feeding one liquid in the tube, both ends of the tube are sealed, and the tube is enclosed in a polyethylene container with the other liquid. The tube can be broken and divided at any position thereof by manually bending the polyethylene container. According to this embodiment, the tube can be broken selectively at one or more unspecified positions thereof to facilitate the mixing of the two kinds of liquids. In this embodiment, the pinholes may be formed on the surface of the tube after enclosing the liquid in the tube.

(Fifth Embodiment)

Figure 18:
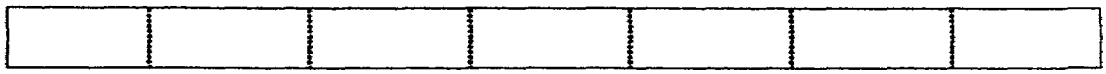

As shown in FIG. 17, a plural number of the needles as described in the fourth embodiment are aligned in contact with each other to form a straight line having a length equal to or greater than the circumferential length of the tube, and a plurality of the aligned needle sets are arranged in parallel with each other at constant intervals. The tube is placed on the acicular ends of the needle sets to extend perpendicular to the direction of each of the lines of the needle sets, and pressed onto and rolled along the acicular ends of the needle sets. As a result, the surface of said tube is formed with a plurality of needle mark or pinhole lines extending along the entire circumferential length of the surface and disposed in parallel with each other in the longitudinal direction of the tube at constant intervals, as shown in FIG. 18. Through a bending operation, a chemiluminescent device using this tube can be broken and divided along the respective pinhole lines at the above intervals. In case of producing a luminous bracelet or wristband using this tube on a commercial basis, the interval of the pinhole lines is preferably set at 1 to 3 cm, more preferably about 2 cm, in view of facilitating the bending operation and the mixing of the liquids.

It is known that a long-term storage causes water permeation through a polyethylene or polypropylene wall of the tube. If water in an oxidizing liquid is mixed in a fluorescent liquid, oxalate in the fluorescent liquid will be decomposed, resulting in deteriorated luminescent performance. The thickness of the wall is inevitably reduced by forming groove or the like in the surface of the tube (ampoule). Thus, the area to be formed with groove or the like should be minimized to prevent accelerated deterioration in quality. From this point of view, the above technique of creating pinholes in the form of dots can advantageously achieve minimized deterioration in quality.

Specific techniques for implementing the present invention in the chemiluminescent device having the ampoule (tube) made of polypropylene have been described in connection with the fourth and fifth embodiments. As a result of applicant's tests for checking a long-term degradation, a desirable long-term storage capability could be obtained in a chemiluminescent device having an oxidizing liquid enclosed in the polypropylene tube (ampoule). The details of the tests will be described below.

1. Preparation of Fluorescent Liquid 0.00342 mol/liter of bis(phenylethynyl)anthracene (hereinafter referred to as "BPEA" for brevity) was added to 1 liter of dibutyl phthalate to prepare 0.123 mol/liter of bis (2,4,5-trichloro carbopentoxyphenyl) oxalate (hereinafter referred to as "CPPO" for brevity). The obtained CPPO was used as a fluorescent liquid.

2. Preparation of Oxidizing Liquid 100 cc of t-butanol was added to 400 cc of dimethyl phthalate, and 85% of hydrogen peroxide solution was added thereto to adjust the concentration of $H_2O_2$ at 0.4 mol/liter. Then, the solution was added with 0.00054 mol/liter of lithium salicylate, and the lithium salicylate was dissolved therein. The obtained solution was used as an oxidizing liquid.

3. Preparation of Container and Tube

A polyethylene pipe having an inner diameter of ϕ11.0 mm and an outer diameter of ϕ14 mm was used as an outer container. Two kinds of tubes made of polypropylene were prepared as an inner tube. One of the tubes had an inner diameter of ϕ5.1 mm and an outer diameter of ϕ7.5 mm, and the other tube had an inner diameter of ϕ8.2 mm and an outer diameter of ϕ10.6 mm.

4. Preparation of Sample A

The oxidizing liquid of 2 ml was poured in the tube of outer diameter ϕ7.5 mm, and then both ends of the tube were sealed off. The entire surface of the tube had a number of pinholes formed therein in advance. The obtained inner tube was inserted into the container. Then, the fluorescent liquid of 4 ml was poured in the container, and both ends of the container were sealed off.

5. Preparation of Sample B

The fluorescent liquid of 4 ml was poured in the tube of outer diameter ϕ10.6 mm, and then both ends of the tube were sealed off. The entire surface of the tube had a number of pinholes formed therein in advance. The obtained tube was inserted into the container. Then, the oxidizing liquid of 2 ml was poured in the container, and both ends of the container were sealed off. That is, this sample was prepared such that the two kinds of liquids were contained in the tube and container in a reverse way to the sample A.

These chemiluminescent devices A and B was enclosed and stored in a glass vessel at 50° C. for 2 weeks, and then the respective states of the liquids were measured. The measurement results are shown in the following Tables 1 to 3.

In the measurement, the concentrations of CPPO, BPEP, $H_2O_2$ and lithium salicylate were quantitatively measured through high-speed liquid chromatography, and water content was measured using a Karl Fischer water analyzer.

The luminescent intensity in Table 3 was measured using a luminance meter available from Minolta Camera Co., Ltd., Japan.

TABLE 1

| | State of Fluorescent Liquid | Just after preparation | After 2 weeks under 50° C. |
|---|---|---|---|
| A | Concentration of CPPO | 0.123 M | 0.117 M |
| B | Concentration of CPPO | 0.123 M | 0.114 M |
| A | Concentration of BPEA | 3.42 mM | 3.39 mM |
| B | Concentration of BPEA | 3.42 mM | 3.33 mM |
| A | Water Content | 234 ppm | 651 ppm |
| B | Water Content | 234 ppm | 665 ppm |

TABLE 2

| | State of Oxidizing Liquid | Just after preparation | After 2 weeks under 50° C. |
|---|---|---|---|
| A | Concentration of $H_2O_2$ | 0.4 M | 0.396 M |
| B | Concentration of $H_2O_2$ | 0.4 M | 0.341 M |
| A | Concentration of lithium salicylate | 0.540 mM | 0.535 mM |
| B | Concentration of lithium salicylate | 0.540 mM | 0.530 mM |
| A | Water Content | 3983 ppm | 3863 ppm |
| B | Water Content | 3983 ppm | 5267 ppm |
| A | Color of Liquids | transparence | transparence |
| B | Color of Liquids | transparence | Green |

TABLE 3

| | Luminescent Intensity (unit: candela (cd/m$^2$)) | | | | | | | |
|---|---|---|---|---|---|---|---|---|
| | After 3 minutes | After 15 minutes | After 1 hour | After 2 hours | After 3 hours | After 4 hours | After 5 hours | After 6 hours |
| Just after preparation: A, B | 14.50 | 9.51 | 8.75 | 5.91 | 4.26 | 3.70 | 2.95 | 2.40 |
| After 2 weeks under 50° C.: A | 12.08 | 7.36 | 6.41 | 5.26 | 4.44 | 3.72 | 2.98 | 2.43 |
| After 2 weeks under 50° C.: B | 9.16 | 5.08 | 4.17 | 3.98 | 3.64 | 3.07 | 2.56 | 2.35 |

As seen in Table 1, the concentration of the CPPO in each of the samples A and B is lowered, because $H_2O$ in the oxidizing liquid transmits through the wall of the polypropylene tube, and the transmitted $H_2O$ is mixed with the fluorescent liquid to decompose the CPPO into pentoxy trichlorosalicylate (PTCSA).

The concentration of the BPEA in the fluorescent liquid of the sample B is lowered, because the BPEA transmits through the wall of the polypropylene tube, and move into the oxidizing liquid. As a result, the color of the oxidizing liquid of the sample B is changed to green. While it is slow, the transmitted BPEA will be decomposed by the hydrogen peroxide in the oxidizing liquid.

The respective water contents of fluorescent liquid in the samples A and B are increased due to the transmission of $H_2O$ as described above.

As seen in Table 2, the concentration of the hydrogen peroxide in the sample B is significantly lowered, because the oxidizing liquid in the sample B is surrounded by both the walls of the polypropylene tube and the polyethylene container, or the greater surface area than that in the sample A, and a small amount of polymerization catalyst and other additions fundamentally contained in the polypropylene and polyethylene decompose the hydrogen peroxide into $H_2O$. It is also known that the t-butanol in the oxidizing liquid can transmit outside through the wall of the polyethylene container.

The water content in the sample B is significantly increased due to the decomposition of the hydrogen peroxide as described above.

The above measurement results prove that the luminescent performance of the sample B is deteriorated due to significant lowering in the concentrations of CPPO, BPEA and $H_2O_2$, and loss of the t-butanol.

As seen in Table 3, the luminescent performance of the sample B is significantly deteriorated at 3-minute, 15-minute, 1-hour and 2-hour time points after the start of chemiluminescence.

Thus, in terms of long-term storage capability, it is effective to enclose an oxidizing liquid in the inner tube made of polypropylene. If a chemiluminescent device having an oxidizing liquid enclosed in the polypropylene tube is put into a package, the long-term storage capability can be enhanced by packing it together with a drying agent.

The present invention can provide a chemiluminescent device having the ampoule made of synthetic resin, capable of preventing the leakage of the chemiluminescent liquid from the container during use and the occurrence of defective products due to shocks in the product distribution process, with excellent hydraulic-pressure resistance at a low cost.

We claim:

1. A chemiluminescent device comprising:

a flexible container;

an approximately cylindrical tube which is made of polypropylene and sealed at both ends, said tube being contained in said flexible container, said tube including a plurality of pinhole-shaped apertures extending from the surface thereof without penetrating through the wall thereof;

an oxidizing liquid enclosed in said tube, said oxidizing liquid including an organic solvent, a hydrogen peroxide solution and a catalyst; and a fluorescent liquid enclosed in said container on the outside of said tube, said fluorescent liquid including an organic solvent, an oxalate and a fluorescent material.

2. The chemiluminescent device as defined in claim 1, wherein said apertures are a number of pinholes formed over substantially the entire surface of said tube in the form of dots.

3. The chemiluminescent device as defined in claim 1, wherein said apertures are a number of pinholes formed in one or more regions extending along substantially the entire circumferential length of the surface of said tube, said regions being disposed individually in the longitudinal direction of said tube.

* * * * *